US005924358A

United States Patent [19]

Motoe et al.

[11] Patent Number: 5,924,358

[45] Date of Patent: Jul. 20, 1999

[54] STENCIL SHEET CLAMPING CONSTRUCTION OF STENCIL PRINTING DRUM WITH STENCIL LIFTER

[75] Inventors: Katsuro Motoe; Mitsuru Takeno; Toshihiro Bansyo, all of Inashiki-gun, Japan

[73] Assignee: Riso Kagaku Corporation, Tokyo, Japan

[21] Appl. No.: 09/090,906

[22] Filed: Jun. 5, 1998

[30] Foreign Application Priority Data

Jun. 17, 1997 [JP] Japan ..... 9-176457

[51] Int. Cl.[6] ..... B41L 13/06

[52] U.S. Cl. ..... 101/116; 101/128.1

[58] Field of Search ..... 101/116, 128.1

[56] References Cited

U.S. PATENT DOCUMENTS 4,966,073 10/1990 Hasegawa et al. ..... 101/120

5,035,175 7/1991 Takita et al. ..... 101/116

5,152,218 10/1992 Ishikawa ..... 101/118

FOREIGN PATENT DOCUMENTS

A-61-104854 5/1986 Japan .

A-5-69648 3/1993 Japan .

*Primary Examiner*—Edgar Burr

*Assistant Examiner*—Leslie J. Grohusky

*Attorney, Agent, or Firm*—Oliff & Berridge, PLC

[57] ABSTRACT

In a stencil sheet clamping construction for clamping a leading end portion of a stencil sheet to a stencil printing drum, a press plate is set at a half open position making an acute angle against an upper surface of a base portion when the leading end portion of the stencil sheet is mounted. This allows the leading end portion of the stencil sheet to be lifted above the upper surface of the base portion by floating up of an elastic film belt when the stencil sheet is discharged. This also prevents obstruction of the smooth advance of the leading end portion of the stencil when it is mounted due to the floating up of the elastic film belt.

6 Claims, 5 Drawing Sheets

STENCIL SHEET CLAMPING CONSTRUCTION OF STENCIL PRINTING DRUM WITH STENCIL LIFTER

BACKGROUND OF THE INVENTION

1. Field of the Invention

The present invention relates to a stencil printing apparatus, and more particularly, to a stencil sheet clamping construction for mounting a leading end portion of a stencil sheet to the outer circumferential surface of a printing drum of a rotary stencil printer.

2. Description of the Prior Art

In Japanese Patent Laid-open Publication 61-104854 based upon an application filed by the same assignee as the present application there has been proposed a stencil sheet clamping construction of a stencil printing drum, comprising a base portion provided at an outer circumferential surface of the stencil printing drum along a generatrix thereof, a press plate provided on the base portion to be selectively pivotable about a pivot axis extending along the base portion between a closed position laid over the base portion and an open position turned oppositely therefrom, means for selectively driving the press plate between the closed position and the open position, and an elastic film belt extending circumferentially relative to the stencil printing drum over an upper surface of the base portion with a first end portion thereof being fastened to the based portion at an edge portion thereof remote from the pivot axis of the press plate and a second end portion thereof opposite to the first end portion being turned around the pivot axis and fastened to the press plate, whereby a leading end portion of a stencil sheet is clamped between the base portion and the press plate together with the elastic film belt extended along the upper surface of the base portion when the press plate is in the closed position, while the elastic film belt floats up above the upper surface of the base portion due to a contraction of the distance between the opposite ends thereof when the press plate is in the open position, so that thereby the leading end portion of the stencil sheet is lifted up from the base portion at a time of discharging the stencil sheet, so as to facilitate and ensure the removal and discharge of the stencil sheet from the stencil clamping means of the printing drum.

Further, in Japanese Patent Laid-open Publication 5-69648 based upon an application filed by the same assignee as the present application there has been proposed a stencil sheet clamping construction of a stencil printing drum improved from the construction by the first-mentioned prior proposal, wherein the elastic film belt is constructed to have a larger modulus of elasticity in its first portion including the above-mentioned first end portion than in its second portion including the above-mentioned second end portion, or the elastic film belt is constructed to include a cantilever type auxiliary piece extending from an intermediate portion between the first and second end portions toward the side of the second end portion, so as to modify the floating up shape of the elastic film belt to be more effective for lifting up the leading end portion of the stencil sheet.

In order that the function of the elastic film belt forming as essential part of the present invention is understood, the stencil sheet clamping construction of the stencil printing drum according to the above-mentioned Japanese Patent Laid-open Publication 61-104854 is described with reference to the accompanying FIG. 1 which is an overall perspective view of the stencil printer and FIGS. 2–4 which are side views of the stencil clamping construction in an enlarged scale, showing three different operating conditions.

In these figures, 1 is a stencil printing drum of a rotary stencil printer, having a construction that annular guide portions 2 provided at opposite axial ends thereof are guided along an annular passage by two sets of support rollers 3 which are supported by a frame of the printer not shown in the figure, so that the stencil printing drum rotates about its central axis. The drum 1 is provided with a base portion 4 at a portion of its circumferential surface along a generatrix thereof, an upper surface 5 of the base portion providing one of the surfaces for clamping a leading end portion of the stencil sheet mounted to the drum. A magnet plate 6 is planted in the upper surface, so that a principal portion of the upper surface 5 is provided by an upper surface 6*a* of the magnet plate 6. A press plate 8 is pivotably mounted to the base portion 4 by bearing portions 7 provided at opposite ends of the base portion 4 via a shaft 9 supported by the bearing portions and supporting the press plate 8 along an inner edge thereof, so that the press plate 8 is pivotable about a pivot axis A extending through the center of the shaft 9. A pinion 10 is mounted to one end of the shaft 9, the pinion being adapted to engage with a rack not shown in the figure, so that thereby the press plate 8 is selectively driven between a closed position such as shown in FIG. 3, where the press plate is laid over the upper surface 5 of the base portion 4, and an open position such as shown in FIG. 4, where the press plate 8 is held by a magnet plate 11 planted in an opposite side portion of the base portion 4.

Above the base portion 4, there is provided an elastic film belt 13 extended circumferentially relative to the stencil printing drum over the upper surface 5 of the base portion, with a first end portion thereof being fastened to the base portion at its edge portion 12 remote from the pivot axis of the press plate and a second end portion thereof opposite to the first end portion being turned around the pivot axis A through the lower side of the shaft 9 and fastened to the press plate. By such a construction that the elastic film belt 13 extending circumferentially relative to the stencil printing drum is fastened to the edge portion 12 of the base portion 4 at the first end portion thereof and to the press plate 5 at the second end portion thereof after having turned around the pivot axis A of the press plate 8, when it is so constructed that the elastic film belt 13 is just completely extended when the press plate 8 is in the closed position laid over the upper surface 5 of the base portion as shown in FIG. 3, and when the press plate 8 is turned oppositely to the open position as shown in FIG. 1, 2 or 4, the second end portion of the elastic film belt 13 is pushed out toward the first end portion, with the elastic film belt 13 floating up arcuately above the upper surface 5 of the base portion 4 between the opposite ends thereof as shown in those figures, due to a contraction of the distance between the opposite end portions thereof.

In the stencil sheet clamping construction of a stencil printing drum according to the above-mentioned prior proposal, when a new stencil sheet is mounted to the printing drum, the press plate 8 is set at the open position as shown in FIG. 2, while a stencil sheet S is transferred by a pair of rollers 14 and 15 and guided by a guide roller 16 so that its leading end portion Sa is just positioned above the base portion 4, although, since the elastic film belt 13 is arcuately lifted up above the upper surface 5 of the base portion, the leading end portion Sa of the stencil sheet is in a condition floated above the upper surface 5 of the base portion and supported by the arcuately lifted elastic film belt 13. Starting from such a condition, when the press plate 8 is driven toward the closed position by the shaft 9, turning about the pivot axis A, the elastic film belt 13 is extended along the upper surface 5 of the base portion 4 as shown in FIG. 3, whereupon the leading end portion Sa of the stencil sheet is clamped between the base portion 4 and the press plate 8 together with the elastic film belt 13 which has just been flatly extended.

When the printing has ended and the used stencil sheet is to be discharged from the printing drum, the press plate 8 is driven again to the open position as shown in FIG. 4. According to the turn of the press plate 8 toward the open position, the elastic film belt 13 floats up above the upper surface 5 of the base plate 4 in the same manner as shown in FIG. 2, so that thereby the leading end portion Sa of the stencil sheet is lifted up from the upper surface 5 of the base portion 4. When the printing drum is rotated counter-clockwise in the figure, the leading end portion Sa of the stencil sheet is scooped up by a discharge claw not shown in the figure, so that the stencil sheet is transferred toward a discharge means, ensuring a definite operation of the stencil discharge means.

The elastic film belt 13 certainly operates to lift up the leading end portion Sa of the stencil sheet above the upper surface 5 of the base portion at discharging of the stencil sheet, as shown in FIG. 4, so that when the printing drum is rotated from this state in the counter-clock wise direction, the leading end portion Sa of the stencil sheet is definitely scooped up by a discharge claw not shown in the figure to be transferred along a stencil discharge passage. However, when the stencil sheet is mounted, as shown in FIG. 2, the elastic film belt 13 arcuately floating up above the upper surface 5 of the base portion 4 does no effective operation, but rather presents a surface traversing a forward movement of the leading end of the stencil sheet transferred by the pair of rollers 14 and 15, shown by a broken line in FIG. 2, thereby adversely affecting a smooth placing of the leading end portion Sa of the stencil sheet upon the upper surface 5 of the base portion 4.

SUMMARY OF THE INVENTION

In view of this, it is a primary object of the present invention to further improve the stencil sheet clamping construction of a stencil printing drum having such an elastic film belt.

The above-mentioned primary object of the present is accomplished by a stencil sheet clamping construction of a stencil printing drum, comprising a base portion provided at an outer circumferential surface of the stencil printing drum along a generatrix thereof, a press plate mounted on the base portion to be selectively pivotable about a pivot axis extending along the base portion between a closed position laid over the base portion and an open position turned oppositely therefrom, means for selectively driving the press plate between the closed position and the open position, and an elastic film belt extending circumferentially relative to the stencil printing drum over an upper surface of the base portion with a first end portion thereof being fastened to the based portion at an edge portion thereof remote from the pivot axis of the press plate and a second end portion thereof opposite to the first end portion being turned around the pivot axis and fastened to the press plate, whereby a leading end portion of a stencil sheet is clamped between the base portion and the press plate together with the elastic film belt extended along an upper surface of the base portion when the press plate is in the closed position, while the elastic film belt floats up above the upper surface of the base portion due to a contraction of the distance between the opposite ends thereof when the press plate is in the open position, characterized in that the press plate drive means holds the press plate at a half open position of expanding an acute angle against the upper surface of the base portion when the leading end portion of a new stencil sheet is introduced into above the base portion for the clamping thereof.

Further, the above-mentioned primary object is more effectively accomplished by that, in the stencil sheet clamping construction of the above-mentioned construction, an elastic part is provided between a portion of the elastic film belt turning around the pivot axis of the press plate and a pivotably mounting portion of the press plate.

BRIEF DESCRIPTION OF THE DRAWINGS

In the accompanying drawings.

DESCRIPTION OF THE PREFERRED EMBODIMENTS

In the following, the present invention will be described with respect to some preferred embodiments.

Figure 1:
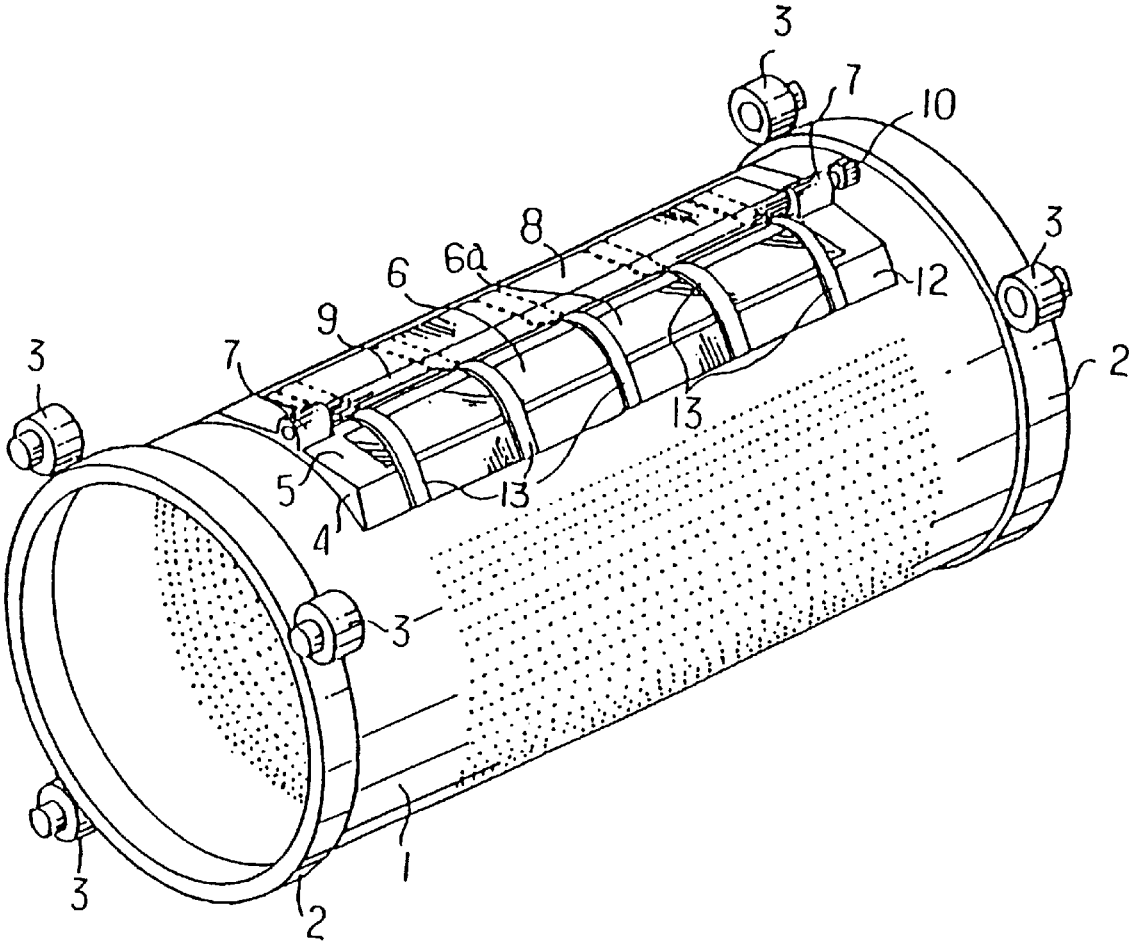
FIG. 1 (PRIOR ART)
FIG. 1 is a perspective view showing the basic construction of the stencil printing drum having a stencil sheet clamping construction to which the present invention is favorably applied.
Figure 2:
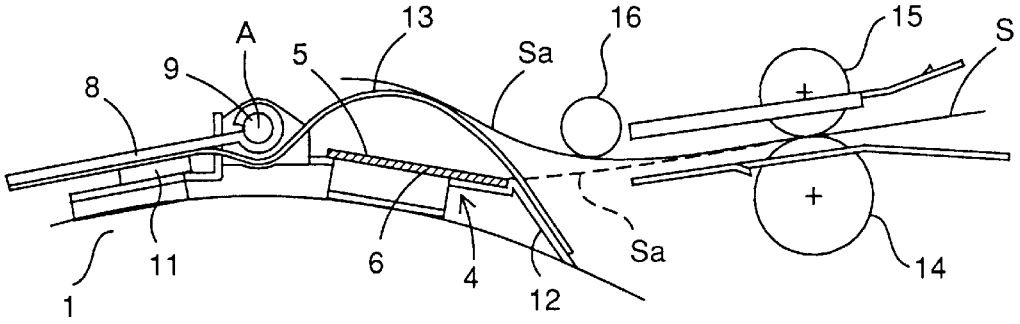
FIG. 2 (PRIOR ART)
FIG. 2 is a side view partly in section, showing an operating condition of the stencil sheet clamping construction shown in FIG. 1.
Figure 5:
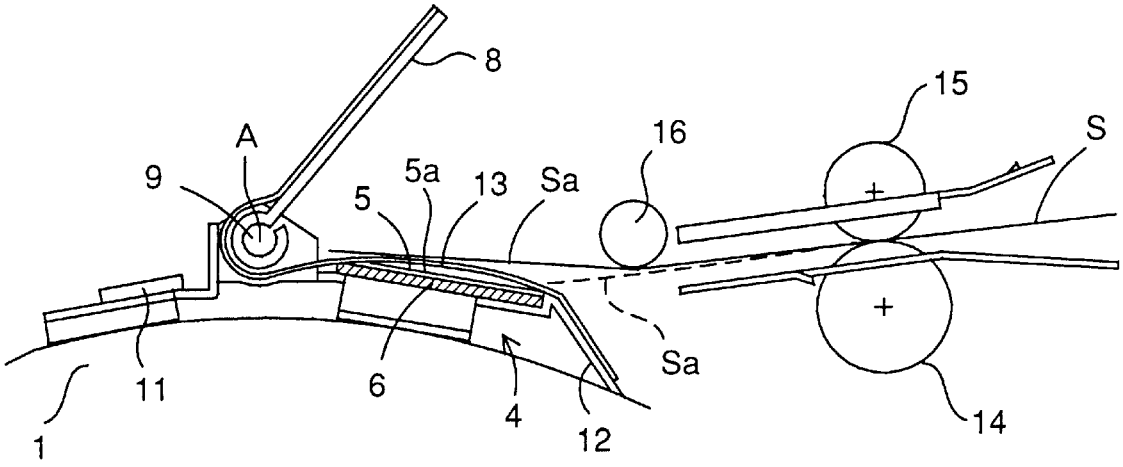
FIG. 5 is a view corresponding to FIG. 2, showing the operating condition of the stencil sheet clamping construction according to the present invention.

FIG. 5 is a diagrammatical side view similar to FIG. 2, partly in section, showing an embodiment of the stencil sheet clamping construction of a stencil printing drum according to the present invention, in an operating condition displaying the essence of the present invention, In FIG. 5, the portions corresponding to those shown in FIG. 2 are designated by the same reference numerals. The structures of various portions expressed in FIG. 5 are the same as those shown in FIG. 2 as each static structure, except that, in this embodiment, the upper surface 5 of the base portion 4 is formed with grooves 5*a*, as more clear in FIG. 6, each being adapted to receive each of the elastic film belts 13 when they are extended.

Figure 3:
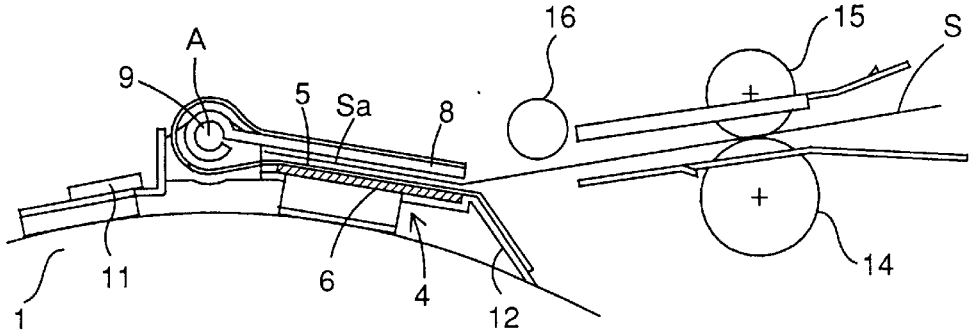
FIG. 3 (PRIOR ART)
FIG. 3 is a view similar to FIG. 2, showing another operation condition of the stencil sheet clamping construction shown in FIG. 1.
Figure 6:
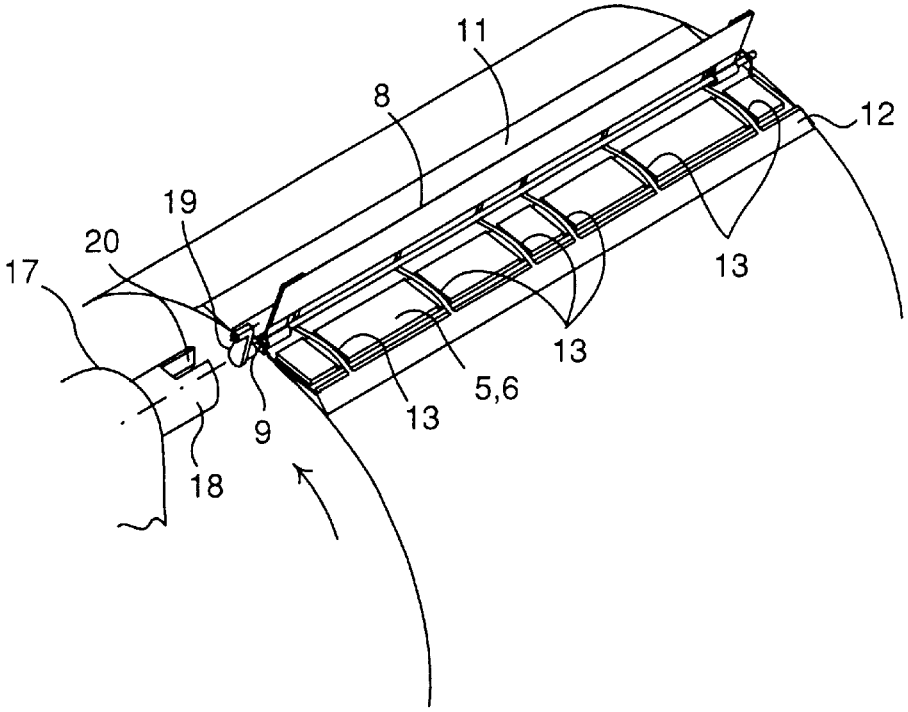
FIG. 6 is a perspective view showing an essential portion of a stencil printing drum equipped with the stencil sheep clamping construction according to the present invention.

In the stencil sheet clamping construction of a stencil printing drum according to the present invention, when a new stencil sheet is mounted to the printing drum, the press plate 8 is held at a half open position making an acute angle against the upper surface 5 of the base portion 4, as shown in FIG. 5. Such a holding of the press plate 8 at the half open position is accomplished by the shaft 9 that supports the press plate 8 being driven by a press plate drive means 17 shown in FIG. 6 as an embodiment able to selectively determine three operational positions, such as a first operational position for setting the press plate 8 to an open position such as shown in FIG. 2, a second operational position for setting the press plate at a closed position such as shown in FIG. 3, and a third operational position for setting the press plate at a half open position such as shown in FIG. 5. In FIG. 6, the press plate drive means 17 has a drive shaft 18 formed with a transverse groove 20 at a tip end portion thereof adapted to torque-transmittingly receive an arm 19 mounted at one end of the press plate support shaft 9 to transversely extend therefrom, the drive shaft 18 being axially shiftable between a retracted position such as shown in FIG. 6, where it is disengaged from the arm 19 and an advanced position to torque-transmittingly engage with the arm 19, as well as rotatable around the central axis thereof in a condition torque-transmittingly engaged with the arm 19, so as to set the press plate 8 to the above-mentioned open, closed and half open positions. The press plate drive shaft 18 is axially advanced to torque-transmittingly engage with the arm 19 of the press plate support shaft 9 when the printing drum 1 is stopped at a predetermined rotational position for mounting a new stencil sheet, while discharging a used stencil sheet.

Figure 7:
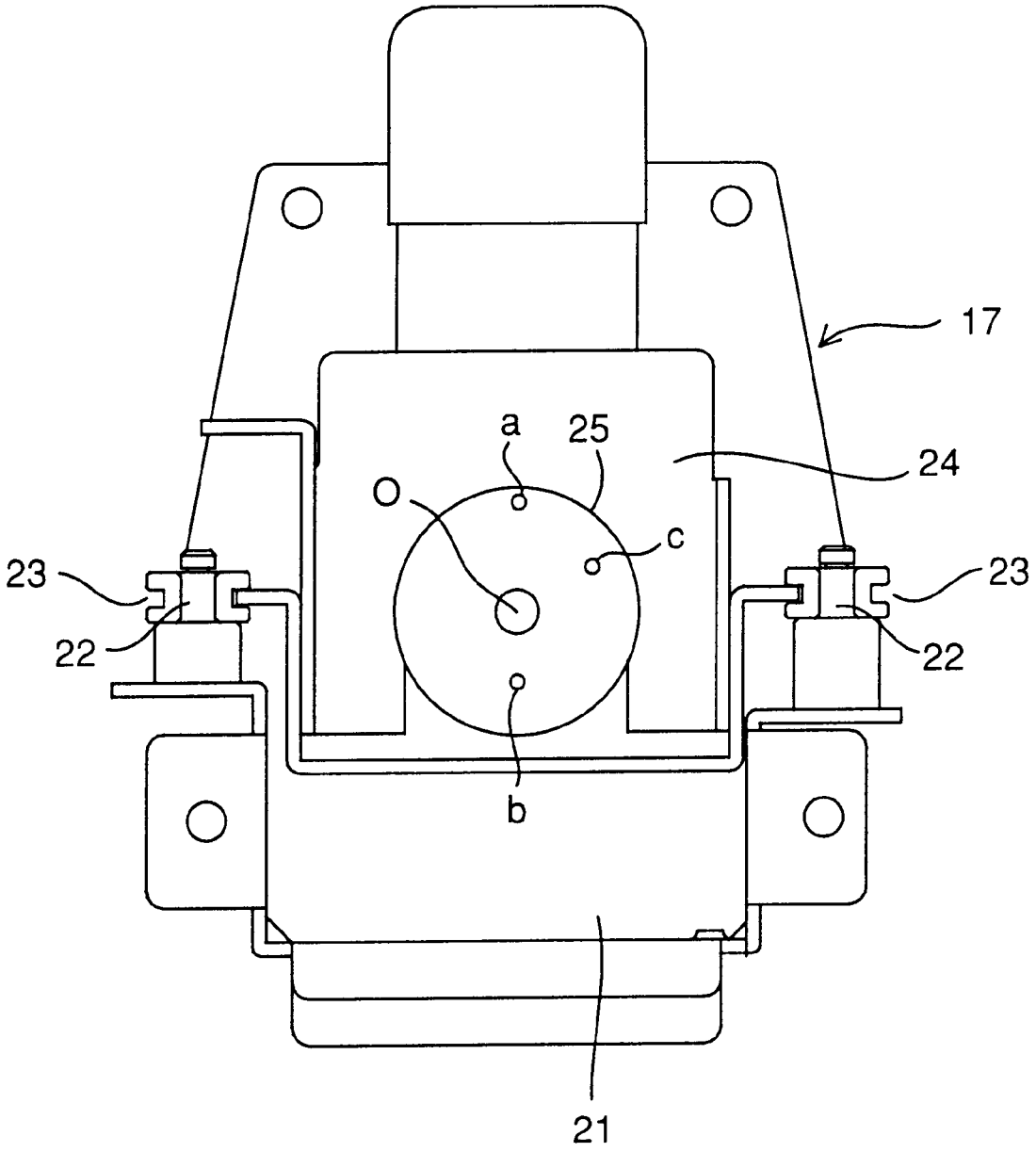
FIG. 7 is a rear view showing an embodiment of the press plate drive means in the stencil sheet clamping construction according to the present invention.

FIG. 7 is a somewhat diagrammatical end view of en embodiment of the press plate drive means 17, corresponding to a back view of a side opposite to the other side where the drive shaft 18 projects. In FIG. 7, the press plate drive means 17 has a body portion 21 fastened to the housing of the printer not shown in the figure, and a head portion 24 supported by the body portion by a pair of shafts 22 and a pair of grooved rollers 23 rotatably supported by the shafts, so as to be movable relative to the body portion in a direction perpendicular to the paper sheet of the drawing, with the drive shaft 18 being supported by the head portion 24 to extend in a direction perpendicular to the paper sheet of the drawing as aligned to point O expressing its central axis. The drive shaft 18 is driven by electric motors and transmission means (both not shown) incorporated in the body portion 21 and the head portion 24 to rotate about the central axis aligned with the point O among the above-mentioned three operational positions in the above-mentioned manner, while the drive shaft 18 is axially moved along the central axis aligned with the point O between the advanced position and the retracted position. The head portion 24 carries a disk 25 integrally rotatable with the drive shaft 18. The disk 25 has small openings a, b and c opened at each different radial position form a central point O. The head portion 24 incorporates light source means (not shown) and three photoelectric sensors (not shown) adapted to respond to light beams emitted from the light source means and passed through the small openings "a", "b" and "c", respectively, so as to set the drive shaft 18 at the above-mentioned three positions according to the signals dispatched from these photoelectric sensors.

In the rotary stencil printer of this type, when the printing by one stencil sheet has ended, the printing drum is left in the condition of bearing the used stencil sheet until a next printing by a new stencil sheet becomes required. Therefore, starting from such a condition, when a printing by a new stencil sheet is carried out, the drive shaft 18 of the press plate drive means 17 is advanced to the press plate 8 of the printing drum stopped at a predetermined stop position, with the leading end portion of the used stencil clamped by the press plate 8 held at the closed position. At this time the drive shaft 18 is at a rotational position corresponding to the small opening "a" of the disk 25 aligning with the corresponding photoelectric sensor, such a rotational position of the drive shaft 18 being such that the transverse groove 20 thereof being in alignment with the arm 19 corresponding to the closed position of the press plate 8.

Figure 4:
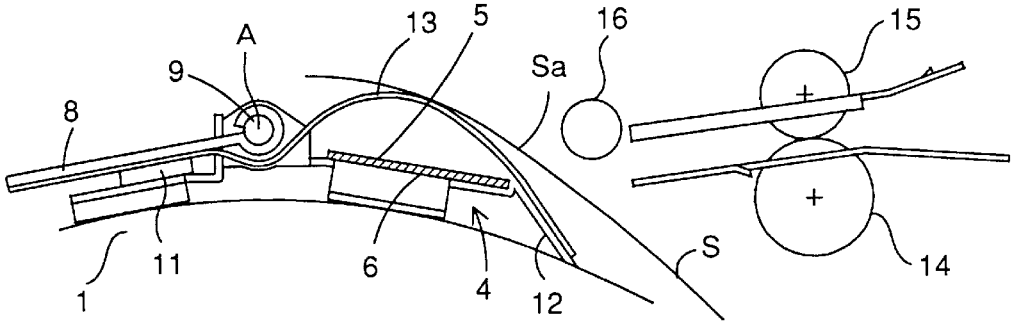
FIG. 4 (PRIOR ART)
FIG. 4 is a view similar to FIGS. 2 and 3, showing still another operating condition of the stencil sheet clamping construction shown in FIG. 1.

When the drive shaft 18 advances until the groove 20 engages with the arm 19, an electronic control circuit not shown in the figure actuates, whereupon the above-mentioned electronic motor is actuated to rotate the drive shaft 18 about its central axis in the normal rotational direction rotating counter-clock wise as viewed in FIG. 5 or 7, so that eh press plate 8 is rotated toward the open position shown in FIG. 4. When the press plate 8 reaches its full open position, the fact is detected by the small opening "b" of the disk 25 aligning with the corresponding photoelectric sensor, so that thereby the electric motor is stopped, and the press plate 8 is held there with the elastic film belt 13 floating up above the upper surface 5 of the base portion 4 in the manner shown in FIG. 4, with simultaneous lifting up of the leading end portion Sa of the stencil sheet as also shown in FIG. 4.

Then the drive shaft 18 of the press plate drive means 17 is axially moved to the retracted position by a next operation of the above-mentioned electronic control circuit. Even after the disengagement of the arm 19 from the drive shaft 18, the press plate 8 is held at the closed position by the magnet plate 11.

Then, the printing drum 1 is slowly driven in the counter-clock wise direction in the figure under the control of the electronic control circuit, whereby the leading end portion Sa of the stencil sheet sufficiently floated up from the upper surface of the base portion as shown in FIG. 4 is scooped up by a discharge claw not shown in the figure according to the rotation of the printing drum, so as to be transferred to the stencil sheet discharge means not shown according to a further rotation of the printing drum, so that thereafter the stencil sheet is peeled off from the printing drum toward the trailing end thereof. Thus, when the printing drum is stopped at the predetermined stop position after one rotation, the stencil sheet clamping construction of the printing drum with press plate 8 held at the open position is set at a position where the shaft 9 thereof opposed the drive shaft 18 in alignment.

Then the electronic control circuit actuates to move the drive shaft 18 of the press plate drive means 17 axially toward the printing drum, so that the groove 20 thereof again engages with the arm 19. Then the electric motor is actuated in the direction opposite to that of the former operation, so as to rotate the drive shaft 18 and the disk 25 in the clockwise direction in the figure, thereby driving the press plate 8 toward the closed position. When the press plate 8 reaches the rotational position shown in FIG. 5, the small opening "c" of the disk 25 aligns with the corresponding photoelectric sensor, which dispatches a corresponding signal, whereupon the electronic control circuit stops the operation of the electric motor, so as to hold the press plate 8 at the half open position as shown in FIG. 5.

When the press plate 8 is brought to such a half open position, a most part of the portion of the elastic film belt 13 extended around the pivot axis of the press plate is wound up around the pivot end of the press plate 8, so that the degree of the floating up of the elastic film belt 13 above the upper surface 5 of the base portion is largely decreased as shown in FIG. 5. Upon the accomplishment of such a condition, the feed of the stencil sheet by the driving of the roller 14 and 15 is started by the electronic control circuit, whereby the leading end portion Sa of the stencil sheet advanced in the condition shown by the broken line is readily transferred to the condition shown by the solid line in FIG. 5. As will be apparent from the condition shown by the broken line, since the floating up of the elastic film belt 13 is decreased in this case, the leading edge of the stencil sheet is not obstructed of its advance by the elastic film belt traversing it at an angle close to verticality as in the case shown in FIG. 2, so that a smoothly guiding along the elastic film belt is available.

When it was detected by the control and watching of the rotation of the rollers 14 and 15 that the leading end portion Sa of the stencil sheet S reached an insert position such as shown by the solid line in FIG. 5, the electronic control circuit resumes the operation of the electric motor in the reversed direction until the press plate 8 is laid over the upper surface 5 of the base portion 4, so that the leading end portion Sa of the stencil sheet and the elastic film belt 13 are clamped between the press plate and the upper surface of the base portion. The state that the press plate 8 reached such a closed position is detected by the small opening "a" of the disk 25 aligning with the corresponding photoelectric sensor, which dispatches a corresponding signal, whereupon the electronic control circuit stops the operation of the electric motor. Thereafter, the electronic control circuit operates the press plate drive means 17 so as to move the drive shaft 18 axially to its retracted position. Even after the groove 20 of the drive shaft 18 has been disengaged from the arm 19, the press plate 8 is held at the closed position under the attraction by the magnet plate 6. After the drive shaft 18 has been brought to the retracted position, under the control of the electronic control circuit the printing drum 1 starts a rotation for winding up the stencil sheet therearound, so that the new stencil sheet is mounted around the printing drum in the manner well known in the art, and then a printing is started.

Thus, according to the present invention, by such an arrangement that the press plate 8 is once held at a half open position of expanding an acute angle against the upper surface of the base portion as shown in FIG. 5 for mounting a new stencil sheet to the printing drum, it is avoided that the leading end portion Sa of a new stencil sheet to be mounted to the printing drum is obstructed of its smooth advance by the elastic film band 13 floating up above the upper surface of the base portion of the prior art construction as shown in FIG. 2, while completely maintaining the advantageous function that the leading end portion Sa of the used stencil sheet is sufficiently lifted up from the upper surface 5 of the base portion 4 when it is discharged from the printing drum as shown in FIG. 4.

Figure 8:
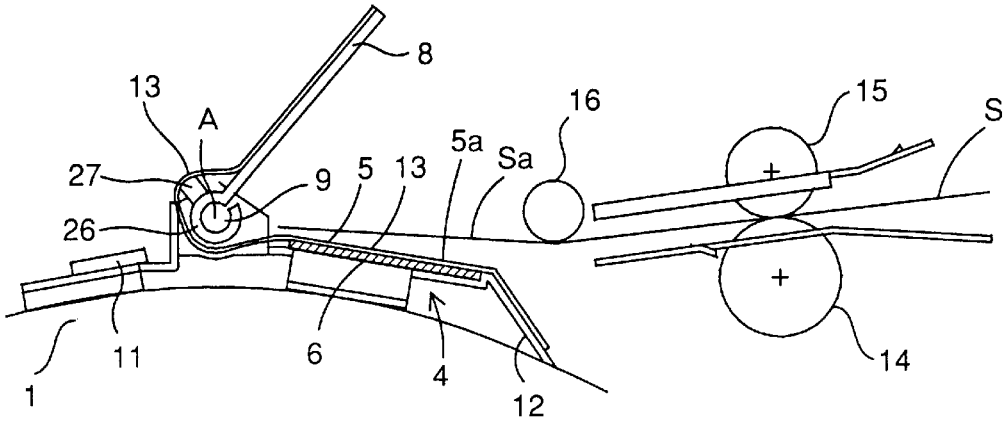
FIG. 8 is a side view partly in section, corresponding to FIG. 5, showing another embodiment of the stencil sheet clamping construction according to the present invention.
Figure 9:
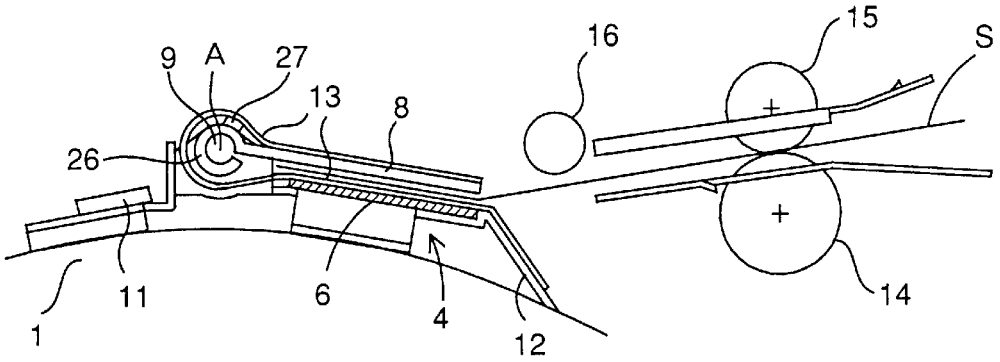
FIG. 9 is a view similar to FIG. 8, showing the stencil sheet clamping construction of FIG. 8 in another operating condition.
Figure 10:
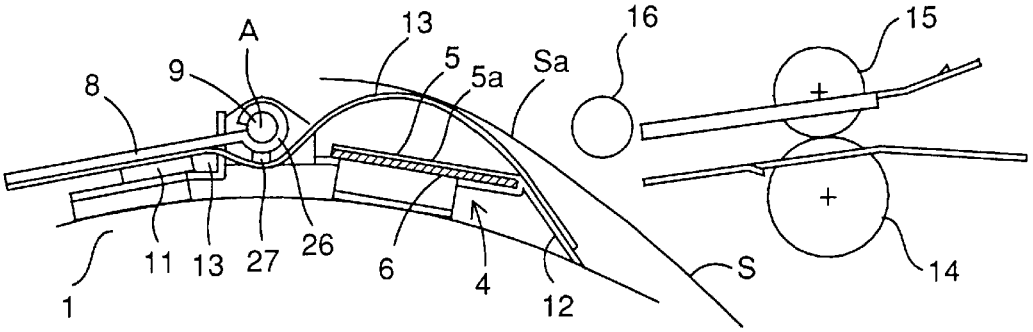
FIG. 10 is a view similar to FIGS. 8 and 9, showing the stencil sheet clamping construction of FIG. 8 in still another operating condition.

FIGS. 8–10 are views showing another embodiment modified from the embodiment shown in FIG. 5, wherein FIG. 8 shows its operating condition corresponding to that of FIG. 5, while FIGS. 9 and 10 show its operating conditions corresponding to those of FIGS. 3 and 4 of the prior art, respectively. In these figures, the portions corresponding to those shown in the preceding figures are designated by the same reference numerals.

In this modification, an elastic pad 27 is provided between a portion of the elastic film belt 13 turning around a pivot portion 26 of the press plate 8 and the pivot portion 26. By such an elastic pad being provided, when the press plate 8 is at a half open position such as shown in FIG. 8, the portion of the elastic film belt 13 turning around the pivotal portion 26 of the press plate is elastically pushed radially outward, so that thereby the portion of the elastic film belt 13 extending along the upper surface 5 of the base portion 4 is further extended until it is substantially seated on the upper surface 5 of the base portion. By such an arrangement that the elastic film belt 13 is more strongly pulled back toward the upper surface of the base portion at a portion thereof extending thereover, it is possible to design the stencil sheet clamping construction so that the elastic film belt 13 floats up more above the upper surface of the base portion then the press plate is fully opened, while definitely avoiding the problem that the floating up of the elastic film belt 13 in the operational phase of mounting the stencil sheet to the printing drum presents an obstacle against the leading edge of the stencil sheet advancing onto the upper surface of the base member.

As will be noted from FIGS. 9 and 10, since the elastic pad 27 is readily contracted by being compressed between the elastic film belt 13 and the pivotal portion 26 of the press plate when the press plate 8 is at the closed position, the elastic pad does not obstruct the press plate 8 being definitely brought to the closed position. When the press plate 8 is at the open position, the elastic pad 27 engages a flatly extended portion of the elastic film belt 13, so that is does not substantially decrease the floating up amount of the elastic film belt 13 above the upper surface 5 of the base portion, thereby operating only effectively when the press plate is at the half open position shown in FIG. 8.

It will be apparent for those skilled in the art that various modifications are possible with respect to the shown embodiments within the scope of the present invention.

We claim:

1. A stencil sheet clamping construction of a stencil printing drum, comprising a base portion provided at an outer circumferential surface of the stencil printing drum along a generatrix thereof, a press plate mounted on the base portion to be selectively pivotable about a pivot axis extending along the base portion between a closed position laid over the base portion and an open position turned oppositely therefrom, means for selectively driving the press plate between the closed position and the open position, and an elastic film belt extending circumferentially relative to the stencil printing drum over an upper surface of the base portion with a first end portion thereof being fastened to the base portion at an edge portion thereof remote from the pivot axis of the press plate and a second end portion thereof opposite to the first end portion being turned around the pivot axis and fastened to the press plate, whereby a leading end portion of a stencil sheet is clamped between the base portion and the press plate together with the elastic film belt being extended along the upper surface of the base portion when the press plate is in the closed position, while the elastic film belt floats up above the upper surface of the base portion due to a contraction of the distance between the opposite ends thereof when the press plate is in the open position, wherein the press plate drive means includes means for holding the press plate at a half open position making an acute angle against the upper surface of the base portion when the leading end portion of a new stencil sheet is introduced into above the base portion for the clamping thereof.

2. A stencil sheet clamping construction of a stencil printing drum according to claim 1, wherein an elastic pad is provided between a portion of the elastic film belt turning around the pivot axis of the press plate and a pivotally mounting portion of the press plate.

3. A stencil sheet clamping construction of a stencil printing drum according to claim 1, wherein the means for holding the press plate at half open position includes first means pivotable about the pivot axis of the press plate together therewith, the first means bearing marking means fixed thereto at a particular angular position thereof about the pivot axis, and stationary second means for detecting the marking means when the marking means traverse a particular stationary angular position so as to thereby provide a signal to the press plate drive means for stopping the press plate at the half open position.

4. A stencil sheet clamping construction of a stencil printing drum according to claim 3, wherein the first means bear marking means fixed thereto at a particular angular position thereof about the pivot axis for signaling the closed position of the press plate and marking means fixed thereto at a particular angular position thereof about the pivot axis for signaling the open position of the press plate, and the second means detect the press plate closed position signaling marking means and the press plate drive means for stopping the press plate at the closed position and the open position, respectively.

5. A stencil sheet clamping construction of a stencil printing drum according to claim 4, wherein the first means are disk means having three small openings serving as the marking means for signaling the half open, closed and open positions of the press plate, respectively, the three small openings being photoelectrically detected by the second means according to the corresponding pivotal movement of the disk means together with the press plate.

6. A stencil sheet clamping construction of a stencil printing drum according to claim 5, wherein the three small openings for signaling the half open, closed and open positions of the press plate, respectively, are remote from the pivot axis by respective distances different from one another.

* * * * *

UNITED STATES PATENT AND TRADEMARK OFFICE

CERTIFICATE OF CORRECTION

PATENT NO. : 5,924,358
DATED : July 20, 1999
INVENTOR(S) : Katsuro MOTOE et al.

It is certified that error appears in the above-identified patent and that said Letters Patent is hereby corrected as shown below:

Claim 4, line 9, after "press plate" insert --open position signaling marking means to provide signals signals to the press plate--.

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*